US006182408B1

(12) United States Patent
Poehler

(10) Patent No.: US 6,182,408 B1
(45) Date of Patent: Feb. 6, 2001

(54) SOLARIUM INTEGRATED MULTI-UNIT BUILDING

(76) Inventor: Joseph G. Poehler, P.O. Box 124, Waterville, MN (US) 56096

( * ) Notice: Under 35 U.S.C. 154(b), the term of this patent shall be extended for 0 days.

(21) Appl. No.: 09/252,285

(22) Filed: Feb. 18, 1999

(51) Int. Cl.[7] ..... E04H 1/00
(52) U.S. Cl. ..... 52/234; 52/200
(58) Field of Search ..... 52/234, 200

(56) References Cited

U.S. PATENT DOCUMENTS

| | | |
|---|---|---|
| 119,242 | 9/1871 | Pleasonton . |
| 1,620,776 | 3/1927 | Monterubio . |
| 3,475,868 | 11/1969 | Johnson . |
| 3,498,368 | 3/1970 | Conangle . |
| 3,932,970 | 1/1976 | Winders et al. . |
| 4,020,989 | 5/1977 | Kautz . |
| 4,186,532 | 2/1980 | Kahn . |
| 4,761,716 | 8/1988 | Mori . |
| 4,837,989 | 6/1989 | Levy . |

OTHER PUBLICATIONS

Tyson's Corner Center store location map, Jun. 1998, Tyson's Corner Center.*

* cited by examiner

*Primary Examiner*—Carl D. Friedman
*Assistant Examiner*—Kevin McDermott
(74) *Attorney, Agent, or Firm*—Faegre & Benson LLP

(57) ABSTRACT

A multi-unit building for residential or commercial use that includes a plurality of dwelling units and an enclosed solarium area that is bordered at least in part by portions of at least two dwelling units. Each of the dwelling units includes an interior space having exterior access and a separate solarium access, the dwelling units and the solarium area are covered by a roof structure, and the solarium area is divided into a plurality of private areas so that a private area is associated with each of the two dwelling units. Each private area is associated with a dwelling unit so that such private area is accessible by way of that unit's solarium access. Preferably, the solarium area also includes a common area for shared usage by tenants of the dwelling units. The solarium area is provided at substantially at the same level as the ground level of the area surrounding the multi-unit building, and the plural dwelling units also preferably completely and equally surround the solarium area so as to define a centrally located area. The environment within the solarium area may advantageously by controlled by artificial systems including automatic control systems.

20 Claims, 4 Drawing Sheets

A
10
78
82
84
86
88
90
92
94
98
102

SOLARIUM INTEGRATED MULTI-UNIT BUILDING

TECHNICAL FIELD

The present invention is directed to the construction of a multi-unit building having an integrated solarium. More particularly, the present invention is directed to the construction of such a multi-unit building that is suitable for residential and/or commercial use, wherein the dwelling units surround an internal solarium area having private and common use area portions under a common roof structure.

BACKGROUND OF THE INVENTION

For a variety of reasons, many different building constructions have been developed within which one or more spaces are provided having at least some aspect of an outdoor environment inside the building construction. That is, one or more elements from the outdoor environment are replicated or allowed to pass from the outdoors to inside the building. Residential and commercial building structures have been developed, for example, in order to take advantage of natural sunlight for lighting, to provide an environment for the display and growing of all types of flora, or to create a more "natural" living space or commercial space that incorporates elements of the outdoors into the buildings.

For the purpose of lighting a living or commercial space by natural sunlight, all sorts of window adaptations have been made. In commercial structures, glass atriums are well known covering courtyard, garden or market place type areas. Typically, such atriums enclose an area between adjacent buildings, or cover an open lobby area within such a building construction. In residential structures, skylights are commonly used, and three season rooms or sun porches are sometimes enclosed by walls and/or roof portions of glass.

As to the enjoyment of flora and growing of all types of plants, greenhouse structures are well known. Greenhouses may be constructed as a glass structure in and of itself, or may comprise a glass structure attached so as to extend from another building. For example, small greenhouse additions to residential and agricultural structures are common.

With respect to any of the type of structures discussed above, it is sometimes also desirable to create a more natural "outdoor" setting in addition to the provision for natural sunlight. That is, planters, gardens and other outdoor setting features may be somewhat duplicated within a residential or commercial building structure. Within the atriums discussed above, garden areas are often provided. In certain apartment buildings, condominiums and hospitals, solarium areas are known to provide residents/patients an area to relax in a more natural setting. In three season rooms and sun porches, planters are also common.

In each of these situations, however, and to varying degrees, these indoor spaces merely artificially simulate an outdoor environment within the building construction. For the purpose of growing plant life, plants are typically either provided in pots or planters or within an artificial soil containing area that has been created within the building construction. But, the main advantage of an artificial environment is that the climate can be effectively controlled within the inside environment so that plants of all varieties can be grown regardless of the diverse climatic conditions that may occur outdoors. In this regard, significant technological advances have been recently made for the provision and control of environmental conditions within building structures.

SUMMARY OF THE INVENTION

The present invention is directed to a building construction that integrates individual residences or commercial spaces with a central solarium so as to create an outdoor environment for the enjoyment of residents or other tenants of the multi-unit structure. By the present invention, a more natural outdoor setting is created and integrated into the individual residences or commercial spaces for the enjoyment and mental and physical well being and health of such persons.

More specifically, the present invention relates to the integration of an enclosed solarium area combined with the benefits of multi-unit residential/commercial usage. For example, the construction in accordance with the present invention would be useful not only for unassisted living, but also would significantly enhance living quarters of those person requiring care and/or assisted living. That is, persons would not only be provided with a suitable indoor facility, they would also have the enjoyment of a natural outdoor setting in a protected and controllable way.

A solarium integrated multiple-unit building in accordance with the present invention comprises a building construction having the multiple units connected together and surrounding a solarium area. The units themselves can be designed specifically for independent or semi-independent living spaces. The solarium area preferably includes private areas associated with each of the multiple units, and a common area. Based on this design, personal interaction with others can be accomplished and encouraged while at the same time maintaining privacy in personal living spaces.

The common area also would preferably benefit from a controlled interior environment. This controlled "outdoor" and protected environment particularly improves a person's habitat by moderating the extremes of climate in various portions of the world so as to promote the well being of the inhabitants whether or not they require care or assistance.

The solarium area has the flexibility so that it may be provided with a range of environmental and garden like settings. As examples, swimming pools, tennis courts, volleyball courts and other venues for promoting enjoyment and growth may be incorporated for the enjoyment and the physical and mental well being of the tenants. The combination of natural light and controlled climate provides a year round facility so that a temperate climate can be enjoyed at any time of the year. To this end, the solarium is preferably equipped with the latest electronically controlled equipment for the purposes of controlling sunlight, temperature, humidity, ventilation, artificial light, color, and sound. Moreover, with existing and newly developed technology, controls, sensors and monitors can be used to maintain the mechanical, electrical and other systems for addressing economy of use, emissions, sound and other environmental concerns.

Natural flora can be provided in the common area or in private areas of the solarium based on the desires of the tenants. The solarium would permit a diversity of plantings and landscapings to be done. For care and maintenance of the solarium, and in particular the common area thereof, access to the solarium without passing through any of the independent units is preferable.

The building in accordance with the present invention may be designed to a multi-level living configuration as well as a single level construction. Multi-level structures could then advantageously add other dimensions to the scale and features of the central solarium area.

The aforementioned advantages are achieved by a multi-unit building for residential or commercial use that comprises a plurality of dwelling units and an enclosed solarium area that is bordered at least in part by portions of at least two dwelling units, wherein each of the dwelling units includes an interior space having exterior access and a separate solarium access, the dwelling units and the solarium area are covered by a roof structure, and the solarium area is divided into a plurality of private areas so that a private area is associated with each of the two dwelling units. Each private area is associated with a dwelling unit so that such private area is accessible by way of that unit's solarium access.

The solarium area may also include a common area for shared usage by tenants of the dwelling units. The solarium preferably is made up at least in part by soil that is otherwise unsupported by any construction of the multi-unit building and wherein the solarium area is substantially at the same level as the ground level of the area surrounding the multi-unit building. The plural dwelling units also preferably completely and equally surround the solarium area so that the solarium area is centrally and evenly located within the plural dwelling units.

To enclose the solarium from the top, a roof structure lies over the solarium area that preferably comprises transparent roofing material. This roof structure over the solarium area is also preferably integrally constructed with the roof structure of the plural dwelling units. The integral roofing construction may utilize integrated truss systems, and preferably, the roofing material over the solarium area includes sections thereof that are substantially coplanar to sections of roof material over the plural dwelling units.

DETAILED DESCRIPTION OF THE INVENTION

Referring to the Figures, wherein like features and components are designated with like numerals throughout the several Figures, one typical construction of a multi-unit building with an integrated solarium is illustrated. It is understood that the FIG.s illustrate but one typical version of a multi-unit building construction and solarium in accordance with the invention. Many other constructions are envisioned in accordance with the present invention that may include single level and multi-level building constructions.

Figure 1:
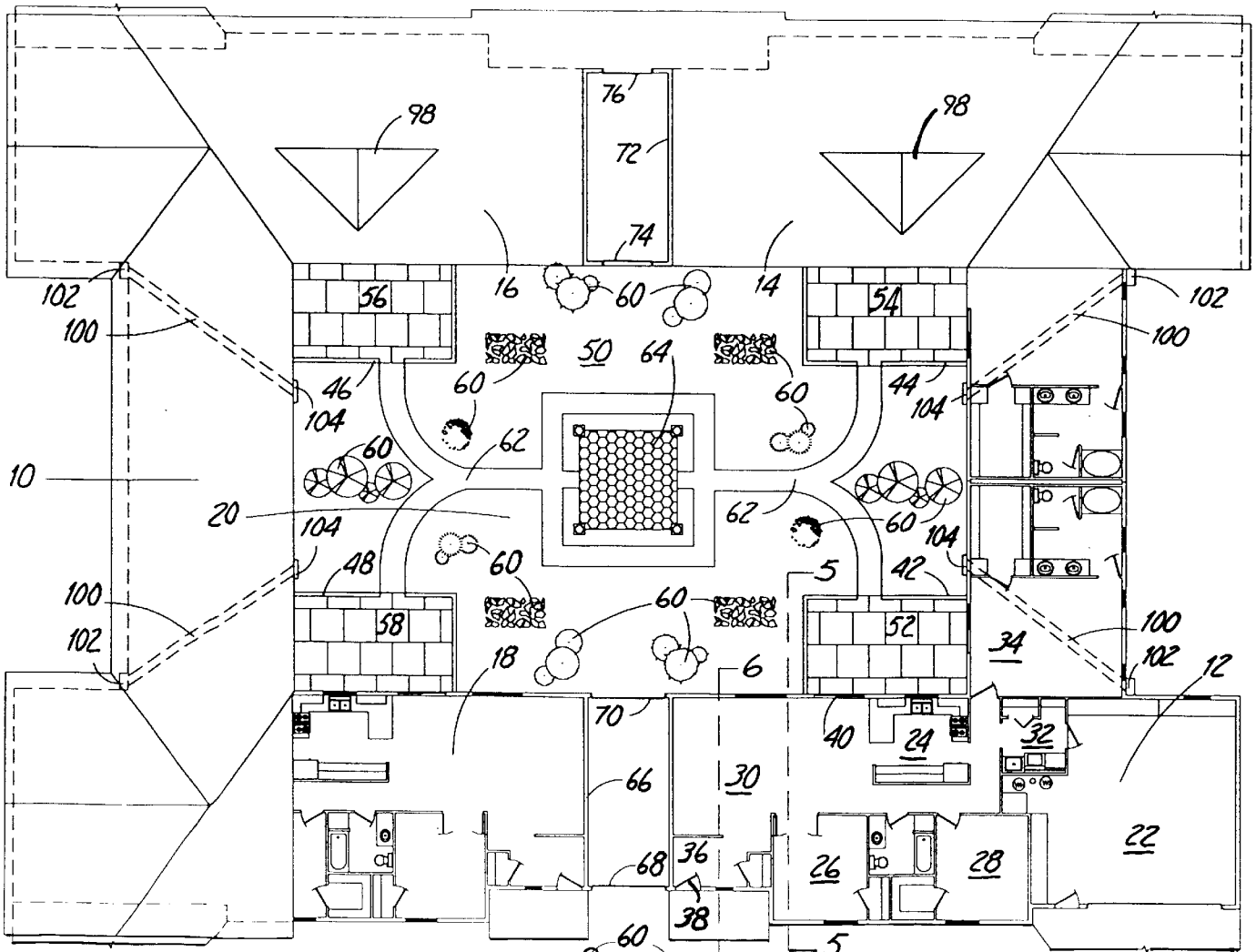
FIG. 1 is a top plan view of a typical multi-unit building construction in accordance with the present invention with a portion of the roof removed so as to illustrate features of multiple dwelling units that surround a central solarium.

A multi-unit building 10 is shown in a top plan view in FIG. 1 that comprises a first unit 12, a second unit 14, a third unit 16, a fourth unit 18, and a solarium area 20.

In the illustrated construction, the first unit 12, second unit 14, third unit 16 and the fourth unit 18 are independent units that are substantially similar to one another in features and construction (although they may be mirror images of one another). It is contemplated, however, that instead the units may be somewhat or completely dissimilar to one another and/or may include common or dependent features between one or more of the units. Furthermore, it is contemplated that more or less units may be provided, and such units may be provided on a single level or multiple levels. Preferably, at least two units are provided having a solarium area 20 enclosed or surrounded by portions of the multiple units. With multiple units, the solarium area 20 can advantageously provide areas thereof that are private or exclusively connected with a particular unit, while a common area can be provided for the enjoyment of all tenants.

Given the above, the first unit 12 is described as follows with the understanding that each of the units 12, 14, 16 and 18 may be similar as illustrated, or otherwise. With reference initially to FIG. 1, first unit 12 is illustrated as a residential dwelling unit that forms approximately one-quarter of the structure of the multi-unit building 10 so as to partially surround the solarium area 20. The first unit 12 comprises a garage 22, a kitchen 24, first and second bedrooms 26 and 28, a living room area 30, utility area 32 and a master suite/bath area 34. A main entryway 36 is also shown including a door 38 for private ingress/egress to the first unit 12. Such private access may otherwise be provided by differently located door(s) or by additional door(s). Of course, any other residential or commercial dwelling configuration is contemplated with the basic understanding that the first unit 12 at least partially surrounds the solarium area 20, and that the first unit 12 has access for its private use versus at least one other independent dwelling unit.

Each of the independent units 12, 14, 16 and 18 also preferably has at least one independent access to the solarium area 20, such as through a sliding door 40 illustrated within first unit 12. Other access ways to the solarium area 20 are also contemplated to be provided instead of the door 40 or in additional thereto, such as through the master suite/bath area 34.

Associated with each of the independent units 12, 14, 16 and 18, the solarium area 20 is preferably divided into defined private areas 42, 44, 46 and 48, respectively. That is, each unit preferably includes its own private portion of the solarium area 20 for the enjoyment/usage of the tenants within that particular unit. The remaining area of the solarium area 20 is preferably to be designated for the common enjoyment/usage of the tenants of all the units 12, 14, 16 and 18 and, in the FIG. 1 illustration, a common area is generally designated as 50. Of course, the proportion of common area to private area can be varied and chosen depending on any particular usage situation. In fact, it is contemplated that the common area 50 may be reduced to nothing so that each of the individual units would be associated with a private area so that the combined area as a sum of each unit's private area would completely take up the solarium area 20. The individual private areas need not be equally sized.

As illustrated, private areas 42, 44, 46 and 48 each include a patio 52, 54, 56 and 58, respectively. The patio areas may also be partially enclosed, such as by screens, lattice, fencing, retaining walls and the like as individually desirable. Moreover, shrubs and plants 60 can be utilized to enhance private areas as they may be provided within the common area 50 or each of the individual private areas 42, 44, 46 and 48. In any case, some definition of private versus common area is desirable. Walkways 62 are also illustrated as may be provided within the common area 50 and possibly within portions of the private areas 42, 44, 46 and 48. Walkways 62 may comprise any known or developed materials, and in the illustrated embodiment, lead to a central feature 64 for the common enjoyment of all tenants. As illustrated, the central feature 64 comprises a brick surface area that can be used as a common gathering area for tenants. The central feature area may instead or in addition include seating, fountains, or other decorative features. Instead of the central feature 64, the common area 50 could include a swimming pool, volleyball court, other sporting venue or other attraction. No central feature or other attraction is required, however, as the common area 50 may simply provide open space, such as including a lawn area. The provision of any features of the common area 50 would likely depend on the particular usage of the multi-unit building 10.

Preferably, the solarium area 20 encompasses and is made up from the soil of the natural land area of a particular building site that is surrounded by the construction of the multi-unit building 10. It is preferable that developing the solarium area 20 would not require any underground construction for the purpose of constraining or otherwise maintaining the soil or other features of the solarium area 20, like in a large planter. Such constraining construction would disadvantageously require that the solarium area 20 be prior excavated and re-filled with soil and/or other materials, or that the solarium area 20 be artificially created above ground level. That is not to say that the soil within the solarium area 20 is not to be worked or engineered so as to facilitate feature or amenities of the solarium area 20 or the construction of the multi-unit building 10. For example, the ground may be graded or excavated to provide certain features, may be trenched for electrical, plumbing, heating or other purposes, or may include other buried components. After complete construction of the multi-unit building 10, the solarium area 20 is preferably substantially at the ground level of the surrounding land.

A common access way 66 is preferably provided so that access can be made to the common area 50 of the solarium area 20 without requiring passage through any of the independent dwelling units 12, 14, 16 or 18. As shown in FIG. 1, access way 66 is provided between units 12 and 18 and preferably includes an exterior door 68 and an interior door 70 through which access to the common area 50 is provided. Doors 68 and 70 may comprise any conventional or developed door constructions, but preferably comprise sliding doors of sufficient size to permit equipment to pass through the appropriately sized access way 66 for maintenance, etc. of the solarium area 20. More preferably, the sizing should accommodate small vehicles (trucks, excavators, vertical staging machines, and the like) so that repair, maintenance or change in the solarium area 20 can be accomplished with the efficiency of mechanical and electrical assistance from proper equipment. The access way 66 may also double as providing limited storage space.

Another maintenance/storage space 72 is shown in FIG. 1 between units 14 and 16. The space 72 can advantageously be used for housing the mechanical/electrical and other electronic equipment that may be utilized for controlling the solarium environment. Moreover, the space 72 can provide storage space for maintenance equipment, tools, and the like. The maintenance/storage space 72 preferably includes at least an interior door 74 for access into the solarium area 20, and may additionally include an external door 76 so as to provide access, for example, for service individuals. It is understood that the access way 66 and maintenance space 72 may be provided anywhere through the perimeter of the multi-unit building 10, but it is preferable that the ingress/egress through the access way 66 be provided in a way so as not to require access through or inconvenience to any one of the dwelling units 12, 14, 16 and 18. Moreover, additional maintenance and storage areas may be provided as required for any particular building usage application, and these spaces need not provide access nor even extend through the multi-unit building 10 to the outside. Similarly, it is contemplated that other or additional spaces or rooms may be provided in the same way as the maintenance space 72. In particular, one or more rooms for common use that might otherwise be impractical in the solarium area 20 could be provided, such as a conference room, consulting room, medical service room, exercise room, etc. Any number of common use rooms may be provided depending on the particular application, and such rooms may or may not include access from the outside, but preferably include access from the solarium area 20.

Figures 2, 3, 4:
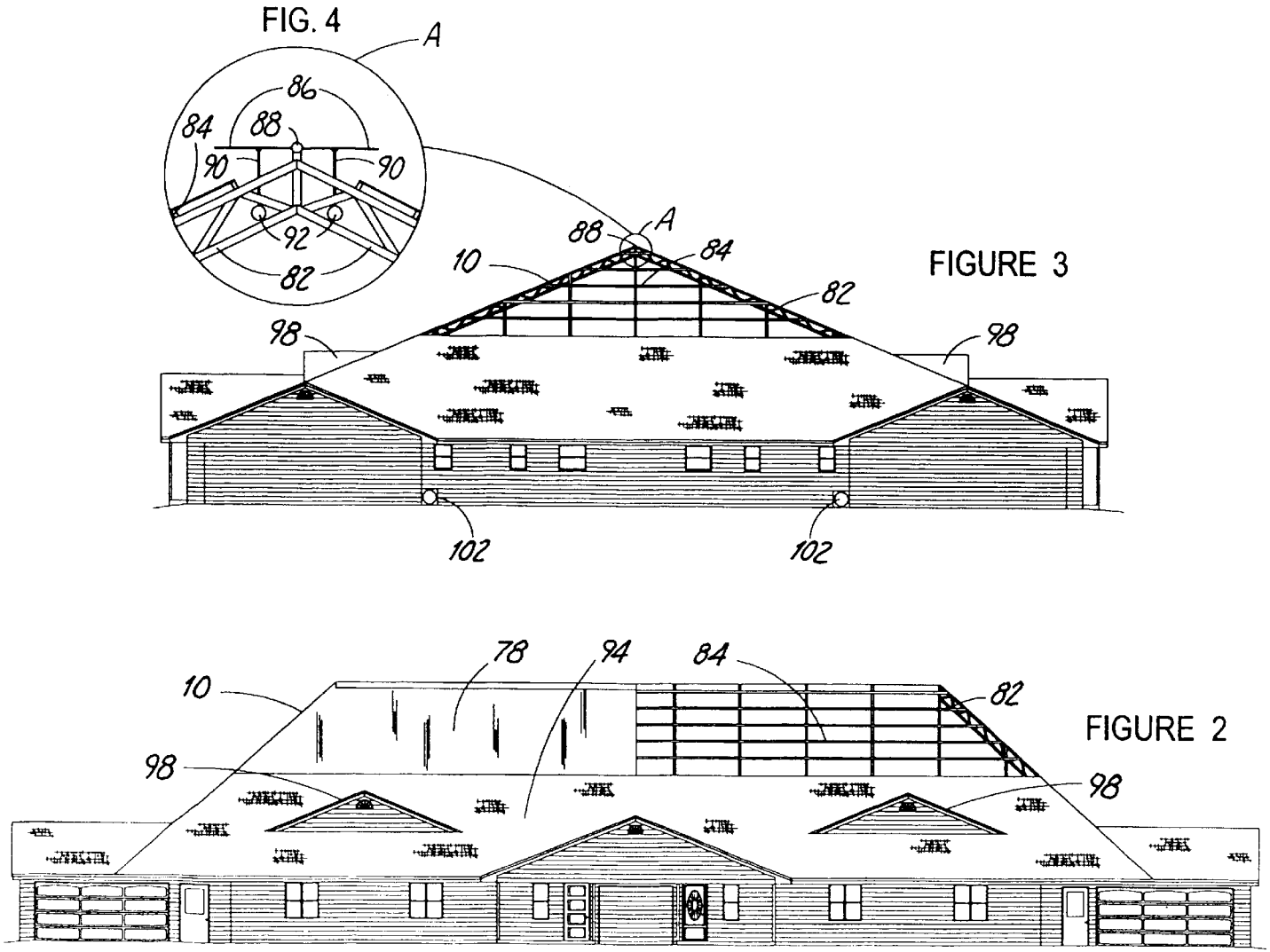
FIG. 2 is a front elevational view of the multi-unit building construction of FIG. 1 with a portion of the solarium roof removed.
FIG. 3 is a side elevational view of the multi-unit building construction of FIGS. 1 and 2 with a portion of the solarium roof removed.
FIG. 4 is an enlarged view of the roof peak structure of FIG. 3 as contained within circle A.

In order to enclose the solarium area 20 from the top, a roof structure is preferably provided as shown in FIGS. 2 and 3. The roof structure covering the solarium area 20 preferably comprises a transparent roofing material 78. In certain applications, translucent and/or opaque roofing materials may be desirable for some or all of the roof over the solarium area 20 (i.e. where artificial lighting is preferred). A transparent roofing material 78 may itself comprise any material suitable for use as an outside/inside barrier and which is sufficiently clear depending on the specific application. Suitable materials include glass and plastic that are well known and which may be in the form of sheets, panels or flexible roll material. Alternatively, the roof may be made up from a coating or other liquid material that is applied to cure in place as the roof material. Such coatings may be applied in multiple layers of the same or different materials. Preferably, the transparent roofing material 78 is installed to allow substantial light transmission where desired and to prevent elements of the outdoor weather from passing through. That is, it is preferable that the roofing material 78 be appropriately sealed to prevent water passage, and that it provide some insulative protection for enhanced temperature control within the solarium area 20. Preferable materials include tempered single pane or double pane insulated glass, or double or triple wall polycarbonate material. Tinting material, such as commercially available films, may be applied, and/or the transparent material 78 may be used in conjunction with automatic or manual shading systems that are conventionally known or hereinafter developed.

The transparent roofing material 78 is preferably supported over the solarium area 20 by a truss system 80 that comprises vertical trusses 82 and horizontal support members 84. The truss system 80 can comprise any conventional truss or other type of roof supporting system that is presently known or hereinafter developed that can adequately support the type of transparent roofing material 78 that is chosen for a particular application.

As shown in FIG. 4, it is further preferable that openable and closable vents be provided along at least one of the peaks of the roof over the solarium area 20. Vents that are permanently open may also be used in appropriate situations. Schematically illustrated in FIG. 4 are a pair of vent panels 86 that extend along the peak 88 of the roof formed by the truss system 80. Each vent panel 86 is preferably moveable between open and closed positions by a remote control system that includes an expandable and retractable strut 90 controlled by an actuator 92. Alternatively, vents can be opened and closed by moving a damper provided within an air duct. In any case, by a proper switched electrical wiring installation, for example, to remote electric motors as the actuators 92, the vent panels 86 can be remotely open and closed. Moreover, it is contemplated that the vent panels 86 may be open and closed as part of an automatic environmental control system based on temperature and other climatic information within the solarium and as discussed in more detail below. As to any of the vent designs, it is also preferable that screening (not shown) be provided to prevent bugs, birds and other animals or other unwanted matter from coming in through the vents.

Figure 5:
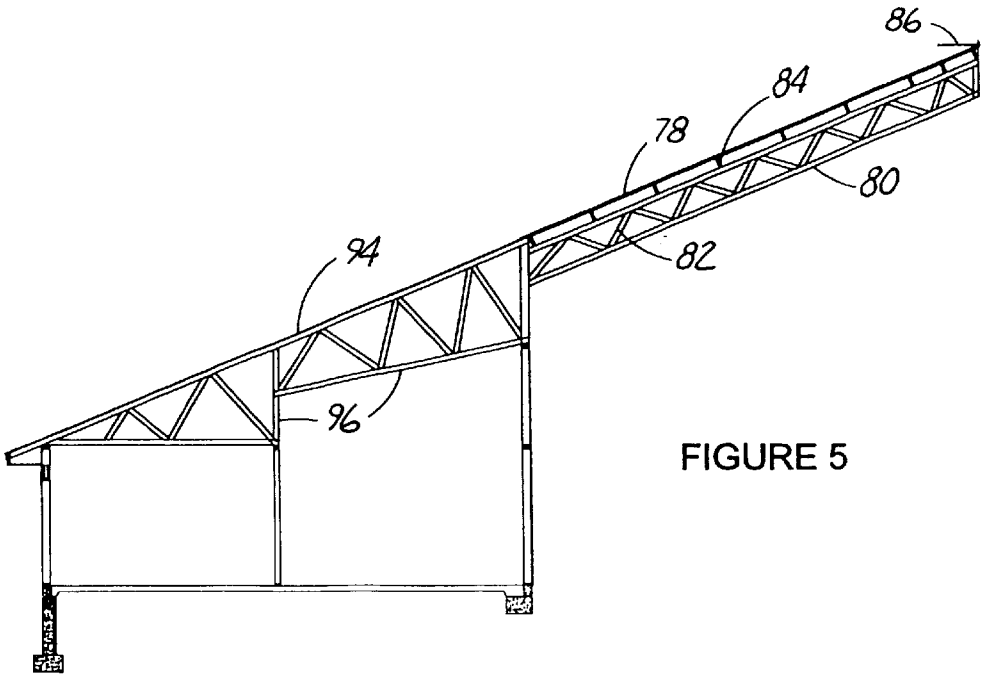
FIG. 5 is a cross-sectional view showing one version of a roof construction taken along line 5—5 in FIG. 1 showing the integration of a building truss system with a solarium roof truss system.
Figure 6:
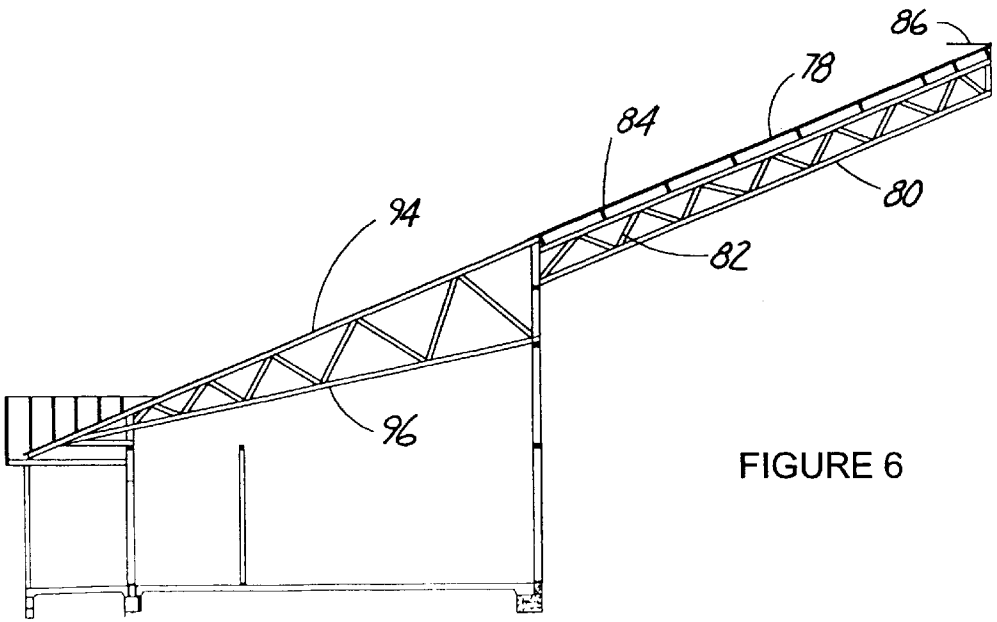
FIG. 6 is a cross-sectional view taken along line 6—6 of FIG. 1 showing a roof construction with integrated building and solarium truss systems.

As shown in FIGS. 5 and 6, the roof structure including the solarium truss system 80 is preferably an integral part of the entire roof of the multi-unit building 10. The transparent roofing material 78 is preferably installed in sections that are in substantially a similar plane as the conventional roofing material 94 of adjacent lower sections of the roof material that primarily covers each of the independent units 12, 14, 16 and 18. Moreover, a building truss system 96 is preferably tied into the truss system 80 over the solarium area 20 to provide an integral roofing structure covering the entire multi-unit building 10. The building truss system 96 itself as well as the other support elements, such as support beams, rafters, studs, and other elements can be designed of and in accordance with conventional and developed building construction techniques. As above with respect to the transparent roofing material 78 itself, it is also highly desirable that the transparent roofing material 78 be sealingly seamed with the conventional roofing material 94 to protect the individual units and the solarium area 20 against weather conditions.

As an additional feature of the multi-unit building 10, it is also preferable that one or more dormers 98 (shown in FIGS. 1, 2 and 3), be provided within the roofing structure over the dwelling units 12, 14, 16 and 18. These dormers advantageously provide spaces within the roofing structure in addition to the attic space for housing heating, ventilating and air conditioning equipment for climate control within the individual units 12, 14, 16 and 18, and/or within the solarium space 20. For example, the dormers 98 could enclose and conceal intake and exhaust mechanisms that would work in conjunction with a natural ventilation system of the solarium area 20 or for separately providing completely conditioned (heated or cooled) air.

Additional possible components of an air ventilation system are air intake ducts 100 that are open to the outside environment through intakes 102 (see FIG. 3) at the external side of the multi-unit building 10. Outlets 104 within the solarium space 20 permit air to pass inside by way of the intakes 102 and air ducts 100. The air ducts 100 may pass through the structure of the building 10, or may be buried below the building structure. Dampers (not shown) for opening and closing the air ducts 100 or for restricting air flow therethrough may also be conventionally provided for air flow control and may be manually or automatically controllable as desired.

In accordance with the above, a natural ventilation system can be made up including the air ducts 100, vent panels 86 and any vents provided within the dormers 98. This natural air ventilation can be further facilitated by the use of fans or other air moving techniques or equipment to provide air circulation within and through the solarium area 20. Taking advantage of the natural flow of air, the air ducts 100 could provide the air intake, while the vent panels 86 could permit exhaust.

As above, it is also contemplated that the solarium area 20 can be artificially heated, cooled, humidified, or otherwise affected by artificial means. This environmental control equipment can be stored within the maintenance space 72, or within any of the attic or dormer structure. Appropriate duct work and venting would be provided in accordance with conventional and developed techniques. Alternatively, heating coils can be buried throughout the solarium area 20, for example, to at least partially control the temperature within the solarium area 20. Where grass and/or plants are provided within the solarium area 20 it may also be desirable to incorporate an automatic irrigation system including buried plumbing components with flexibility to serve any and all areas of the solarium area 20.

In addition, sensors of any type can be strategically placed all about the solarium area 20. Such sensors can be connected to automatic environmental control systems including computer systems having programming so that the climatic control systems, for example, can have an immediate response for maintaining preset conditions. Environmental conditions that may be controlled include not only climatic conditions (e.g. temperature, humidity, air quality, etc), but may include other environmental conditions, such as sound or lighting conditions that may be the same or different over the solarium area 20 and/or may change in accordance with the time of day, for example. Many types of computerized environmental control systems are presently known including sensors and monitors for all types of climatic and other environmental conditions. Sensors and monitors are supportable anywhere within the solarium area 20 from the ceiling formed by the roof structure to the ground depending on the environmental factor to be sensed and the desired affect at any given location. Such environmental control systems may be also operatively connected with automatic shading systems (as discussed above) and may also control the operation of components of a natural ventilation system including dampers, fans and vent panels 86. Thus, the natural ventilation can be advantageously used on temperate days by controlled operation of intake air through air ducts 100 and exhaust through the open vent panels 86. At other times, the heating and air conditioning equipment, such as contained in the attic and dormers 98, can provide for complete climatic control within the solarium area 20. Any amount of lighting and sound system equipment and sensors can be provided as well within the solarium space 20 up to the ceiling and/or at various levels within the solarium area 20 so as to complete the total environment of the solarium area 20.

Figure 7:
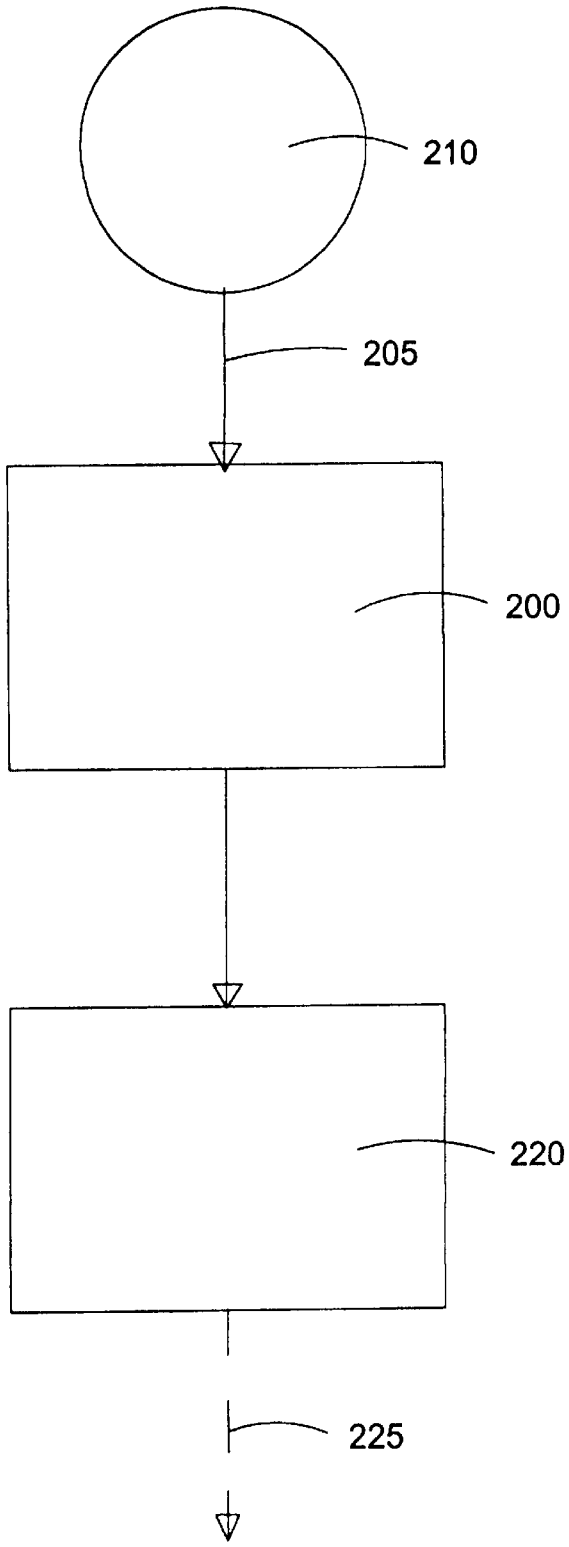
FIG. 7 is a schematic illustration of a control system including a sensing device for monitoring an environmental condition within the solarium area and for effecting a change of that environmental condition based upon the sensed information by way of an artificial conditioning system.

A simple schematic illustration of a sensing and control system usable for artificially controlling any of the above-noted environmental conditions is shown in FIG. 7. A control means 200 is operationally connected to a sensing device 210 that has the ability to monitor a desired environmental condition within the solarium area 20. The control means is further operationally connected to an environmental conditioning system 220 that is used for effecting a change of that environmental condition based upon the sensed information. To do this, the sensing device monitors a desired environmental condition and sends an input signal 205 to the control means 200 that is representative of the sensed condition. Based upon that input signal 205 and the programming (or other logic, if any) of the control means 200, a signal 215 is sent from the control means 200 to the environmental conditioning system 220 instructing it to activate or not. The effort (mechanical or otherwise) that is effected by the environmental conditioning system 220 is represented by the dashed arrow 225.

If there is no logic or other factors to be considered by the control means 200, the sensing device 210 may be directly connected with the environmental conditioning system 220 for simply turning it on and off. The control means 200 may comprise any suitable processing device or system depending on the sophistication of the environmental control system. For example, a computer or other microprocessor could be used, in which case, a single processor could monitor any number of environmental conditions and could effect environmental changes based upon any number of factors. These factors may include conditions that are monitored or may be factors that are programmed into its logic (such as acceptable ranges of conditions based upon one or more sensed factors). Alternatively, many distinct control systems may be utilized instead of just one.

In accordance with the above, it can be seen that an isolated solarium area 20 can be provided in combination with a multi-unit building 10. As described, it is preferable that the dwelling units 12, 14, 16 and 18 (or any plural number of units) completely surround the solarium area 20. However, it is not necessary that the entire perimeter of the solarium area 20 actually be surrounded by a room or dwelling area of a particular unit. In other words, the solarium area 20 may instead be closed at one or more of its sides or portions thereof by merely providing a wall that divides the solarium area 20 from the outdoors. It is preferable, however, that the units utilize the full extent of the space around the perimeter of the solarium area 20 for maximum usage.

Furthermore, by providing additional levels to the multi-unit building 10 constructed as shown in FIGS. 1–3, a larger volume solarium space can be provided that may include additional solarium features. For example, balconies, staircases, bridges, and the like could easily be adapted within the solarium space, and in accordance with the above, could provide private as well as common areas within the total solarium area 20.

What is claimed is:

1. A multi-unit building for residential or commercial use comprising a plurality of dwelling units, including at least a first dwelling unit and a second dwelling unit, and an enclosed solarium area that is bordered at least in part by portions of both of said first and second dwelling units, wherein each of said first and second dwelling units includes an interior space, said interior space of each of said first and second dwelling units having an exterior access for ingress and egress between the interior space and outside and a solarium access for ingress and egress between the interior space and the solarium area, said first and second dwelling units and said solarium area are covered by a roof structure, and said solarium area is divided into a plurality of private areas so that a private area is associated with each of said first and second dwelling units and so that an associated private area of each of said first and second dwelling units is accessible by way of its solarium access.

2. The multi-unit building of claim 1, wherein said solarium area further comprises a common area for shared usage by tenants of the first and second dwelling units.

3. The multi-unit building of claim 2, wherein said private areas comprise patios.

4. The multi-unit building of claim 1, wherein at least a portion of said solarium area comprises soil that is otherwise unsupported by any construction of the multi-unit building.

5. The multi-unit building of claim 4, wherein said solarium area is substantially at the same level as the ground level of the area surrounding the multi-unit building.

6. The multi-unit building of claim 5, wherein said plurality of dwelling units completely surround said solarium area so that said solarium area is centrally located within said plurality of dwelling units.

7. The multi-unit building of claim 6, wherein each of said plurality of dwelling units surrounds a substantially equal portion of said solarium area.

8. The multi-unit building of claim 1, wherein at least portion of said roof structure that lies over said solarium area comprises roofing material that is transparent.

9. The multi-unit building of claim 8, wherein substantially the entire portion of said roof structure that lies over said solarium area comprises roofing material that is transparent.

10. The multi-unit building of claim 8, wherein the roof structure that lies over said solarium area is integrally constructed with the roof structure that lies over said plurality of dwelling units.

11. The multi-unit building of claim 10, wherein the roof structure that lies over said solarium area comprises a truss system that is integrally constructed with a truss system of the roof structure that lies over said plurality of dwelling units.

12. The multi-unit building of claim 10, wherein the roofing material of the roof structure that lies over said solarium area comprises sections thereof that are substantially coplanar to sections of roof material of the roof structure that lies over said plurality of dwelling units.

13. The multi-unit building of claim 8, wherein the roof structure that lies over said solarium area forms at least one peak that includes a vent that permits air flow from within the solarium area to outside.

14. The multi-unit building of claim 13, further comprising an intake airway located below the vent to permit air to enter into the solarium area from the outside.

15. The multi-unit building of claim 1, further comprising means for artificially controlling an environmental condition within said solarium area.

16. The multi-unit building of claim 15, further including a control means that receives an input signal from a sensing device that monitors at least one environmental condition within said solarium area and that subsequently provides a signal to a means for artificially controlling that monitored environmental condition based upon the input signal from the sensing device.

17. The multi-unit building of claim 1, further including a common access way for ingress/egress between the solarium area and outside without requiring passage through any dwelling unit of said plurality of dwelling units.

18. The multi-unit building of claim 2, further including a common access way for ingress/egress between the solarium area and outside without requiring passage through any dwelling unit of said plurality of dwelling units.

19. The multi-unit building of claim 18, wherein said common access way runs from a perimeter of said solarium area and between said first and second dwelling units to the outside.

20. The multi-unit building of claim 19, further including an exterior door that can open and close the access way from the outside and an interior door that can open and close the access way from the solarium area.

* * * * *